United States Patent [19]

Van Veldhoven

[11] Patent Number: 4,662,853

[45] Date of Patent: May 5, 1987

[54] METHOD OF MANUFACTURING A COLOR DISPLAY TUBE AND DEVICE FOR CARRYING OUT SAID METHOD

[75] Inventor: Gerardus A. W. Van Veldhoven, Eindhoven, Netherlands

[73] Assignee: U.S. Philips Corporation, New York, N.Y.

[21] Appl. No.: 835,509

[22] Filed: Mar. 3, 1986

[30] Foreign Application Priority Data

Mar. 25, 1985 [NL] Netherlands ..... 8500862

[51] Int. Cl.[4] ..... H01J 9/236

[52] U.S. Cl. ..... 445/3; 315/368; 445/63

[58] Field of Search ..... 445/3, 34, 63; 315/368; 335/212, 284

[56] References Cited

U.S. PATENT DOCUMENTS

| | | | |
|---|---|---|---|
| 4,189,659 | 2/1980 | Andre et al. | 445/3 |
| 4,211,960 | 7/1980 | Barten et al. | 315/368 |
| 4,220,897 | 9/1980 | Barten et al. | 315/368 |
| 4,578,661 | 3/1986 | van Rijsewijk | 335/212 |

FOREIGN PATENT DOCUMENTS

| | | | |
|---|---|---|---|
| 123611 | 10/1984 | European Pat. Off. | 445/3 |
| 2842818 | 4/1980 | Fed. Rep. of Germany | 445/3 |
| 32640 | 4/1981 | Japan | 445/3 |
| 1540817 | 2/1979 | United Kingdom | 315/368 |

*Primary Examiner*—Kenneth J. Ramsey

*Attorney, Agent, or Firm*—Thomas A. Briody; William J. Streeter; Leroy Eason

[57] ABSTRACT

A method of and a device for use in manufacturing a color display tube in which magnetic poles are provided in or around the neck (4) of the tube envelope (1) and around the paths of the electron beams (18, 19, 20) extending substantially parallel to the axis (8) of the tube, said magnetic poles generating a permanent multipole magnetic field for the correction of the convergence, color purity and frame defects of the color display tube. The magnetic poles are formed by magnetization of a configuration of a magnetizable material (15) which is provided around the paths of the electron beams (18, 19, 20), said configuration being magnetized by energizing a multipole coil unit (21–28) by means of a combination of currents (Ia-Ih) which generate a static multipole magnetic field and the magnetization is produced by means of a decaying alternating magnetic field which initially drives the magnetizable material on both sides of the hysteresis curve into saturation. If the magnetization takes place within one frame period and the decaying alternating magnetic field has a frequency between 400 Hz and 4000 Hz, in which the decrease of the amplitude of the alternating magnetic field is less than 10% per half a cycle, an inexpensive and rapid method of magnetization is achieved in which it is not necessary to switch off the voltages at the gun electrodes (5, 6, 7) and the currents through the deflection coils (13) during magnetization.

5 Claims, 6 Drawing Figures

METHOD OF MANUFACTURING A COLOR DISPLAY TUBE AND DEVICE FOR CARRYING OUT SAID METHOD

BACKGROUND OF THE INVENTION

1. Field of the Invention

The invention relates to a method of manufacturing a colour display tube in which magnetic poles are provided in or around the neck of the envelope and around the paths of the electron beam extending substantially parallel to the axis of the tube, said magnetic poles generating a permanent multipole magnetic field to correct the occurring convergence, colour purity and frame defects of the colour display tube, said poles being formed by magnetizing a configuration of a magnetizable material which is provided around the paths of the electron beams, said configuration being magnetized by energizing a multipole coil unit by means of a combination of currents with which a static multipole magnetic field is generated and the magnetization is produced by means of a decaying alternating magnetic field which initially drives the magnetizable material on both sides of the hysteresis curve into saturation.

The invention also relates to a device for carrying out said method.

2. Description of the Related Art

Such a method and device are disclosed in U.S. Pat. No. 4,220,897.

In a colour display tube of the "in-line" type three electron guns are placed in the neck of the tube so that the axes of the three guns are situated substantially in one plane, the axis of the central electron gun coinciding substantially with the axis of the display tube. The two outermost electron guns are situated symmetrically with respect to the central gun. In a colour display tube of the "delta" type, three electron guns are provided in a triangular arrangement in the neck of the tube. The points of intersection of the gun axes with a plane perpendicular to the tube axis constitute the corners of an equilateral triangle. As long as the electron beams generated by the electron guns are not deflected, the three electron beams both in tubes of the "in-line" type and of the "delta" type, must coincide in the centre of the display screen (static convergence). However, because during the manufacture of the display tube deviations from the frame shape, the colour purity and the static convergence occur, for example, the electron guns are not sealed quite symmetrically with respect to the tube axis, it must be possible to correct said deviations. Such a colour display tube of the "in-line" type in which this is the case is disclosed in U.S. Pat. No. 4,211,960 which may be considered to be incorporated herein. Said patent discloses a colour display tube in which the said deviations are corrected by magnetizing a ring of a magnetizable material as a result of which a static magnetic multipole is formed around the paths of the electron beams. Said ring is provided in or around the neck of the tube. In the method described in said U.S. Pat. No. 4,211,960 the colour display tube is actuated after which data regarding the value and the direction of the convergence errors of the electron beams are established with reference to which the polarity and strength of the magnetic multipole are determined which are necessary for the correction of the frame, colour purity and convergence errors. The magnetization of the configuration, which may consist of a ring, a band or a number of rods or blocks arranged around the electron paths, is carried out in the manner described in the opening paragraph in which a multipole is obtained by one overall magnetization. The magnetization achieved by this single step often is not good and one or more magnetization steps must still be carried out. This is the result of the spreading in the magnetic hardness of the material of the configuration to be magnetized, the spreading in the coupling between the configuration to be magnetized and the magnetizing coils, the spreading in the form of the the configuration to be magnetized and the location of other metal components in the proximity of said configuration. Each magnetization step requires an amount of time for controlling the desired correction. During the magnetization process the voltages at the electrodes of the electron gun and the currents through the deflection coils must also be switched off.

SUMMARY OF THE INVENTION

It is an object of the invention to provide a cheaper and more rapid manner of magnetization in which it is not necessary to switch off the voltages at the gun electrodes and the currents through the deflection coils during the magnetization.

Another object of the invention is to provide a device with which said magnetization can be realized.

According to the invention, a method of the kind described in the opening paragraph is characterized in that the magnetization takes place within a frame period and the decaying alternating magnetic field has a frequency between 400 Hz and 4000 Hz, the decrease of the amplitude of the alternating magnetic field being less than 10% per half a cycle.

By choosing the frequency of the decaying alternating magnetic field to be much larger than the frequency of the field deflection field, namely 50 Hz (in Europe) or 60 Hz (in USA) corresponding to frame periods of 20 ms and 16.6 ms, respectively, and much smaller than the frequency of the line deflection field, namely 15625 Hz, switching off the current through the deflection coils has proved to be unnecessary during the magnetization. Because current flows through the magnetization coils only during the magnetization, the quantity of power applied to said coils is restricted. As a result of this the coils become less warm, which is a contribution to an accurate magnetization. An alternating magnetic field having a frequency of 50 Hz has so far often been used. This field caused a vibration in the electron gun components as a result of which loose particles occurred in the tube which gave rise to flash-overs between the gun electrodes which were at a high voltage. It was therefore necessary to remove the voltages from the electrodes during the magnetization. The frequency used now of, for example, approximately 1700 Hz does not result in gun vibrations and electrical flashovers between the electrodes, so that the electric voltages can remain present on the gun electrodes during the magnetization process.

Very good results are obtained if the decaying alternating magnetic field has a frequency between 1650 Hz and 1750 Hz, the decrease of the amplitude of the alternating magnetic field being less then 7% per half a cycle.

The decaying alternating magnetic field can be generated by means of the magnetization coils by superimposing the high frequency alternating current on the direct currents through said coils.

However, the alternating magnetic field may also be generated by means of a number of alternating field coils the axes of which extend radially away from the axes of the magnetization device just like the axes of the magnetization coils, as is described in the said U.S. Pat. No. 4,220,897. By energizing said coils with a phase difference, a rotating decaying alternating magnetic field can be generated.

As described in Netherlands Patent Application No. 8403112 which has been laid open to public inspection since filing the present application, the decaying alternating magnetic field may also be an axial magnetic field which is substantially parallel to the electron beams.

A device for carrying out the method is characterized according to the invention in that the said device comprises the following elements:

(a) a multipole unit comprising a number of magnetization coils which are positioned around the tube axis in a regular manner and the axes of which extend substantially radially of the tube axis, (b) four alternating field coils which are positioned around the tube axis in a regular manner and the axes of which also extend substantially radially of the tube axis and of which each pair of coils situated diametrically oppositely to each other forms part of a current circuit which further comprises a switching element and a capacitor, (c) a supply unit for charging the capacitors, and (d) a control for the switching elements.

This device conveniently comprises eight magnetization coils with which it is possible to make two-poles, four-poles, six-poles and eight-poles and combinations of these multipoles. By energizing the alternating field coils in this manner it is possible to magnetize within a frame period. The decrease in the speed of the rotating alternating magnetic field is determined by the Q-factor of the two oscillating circuits which are each formed by two oppositely located coils and a capacitor. As a result of the choice of said oscillatory circuits the decrease in speed is constant and such that the rotating decaying magnetic field has decayed within one frame period. The rotating field is started by means of the (controlled) switching element in each circuit. By synchronization of the start of the rotating decaying alternating magnetic field with respect to the field deflection, magnetization in a reproducible manner can be carried out with the field and line deflections switched on.

A preferred embodiment of the device in accordance with the invention is characterized in that compensation coils which are connected in series with the coils of the multiple coil unit are provided around the axes of the alternating field coils on the side remote from the axis. These compensation coils serve to neutralize the field induced in the magnetization coils of the multipole unit by the alternating field coils.

BRIEF DESCRIPTION OF THE DRAWINGS

The invention will now be described in greater detail, by way of example, with reference to the accompanying drawings, in which.

DESCRIPTION OF THE PREFERRED EMBODIMENTS

Figure 1:
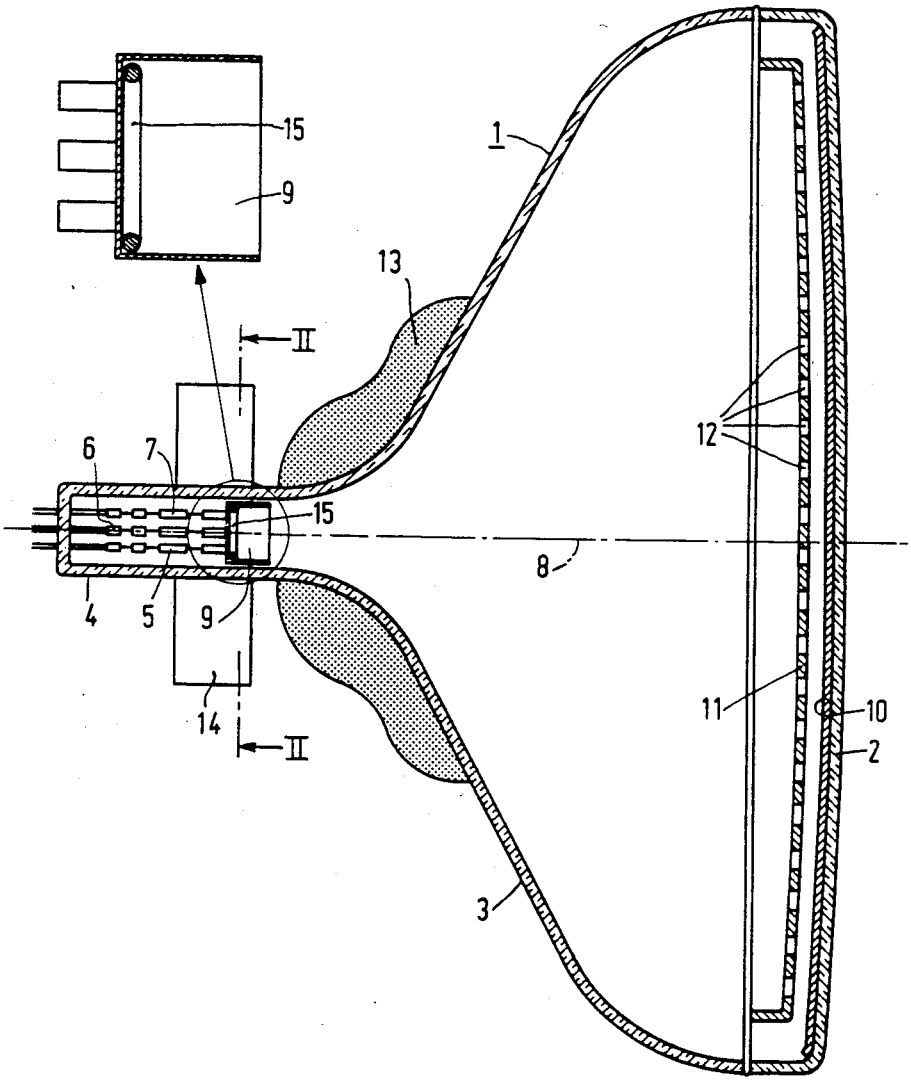
FIG. 1 is a longitudinal sectional view of a colour display tube of the "in-line" type in a magnetization device according to the invention.

FIG. 1 is a diagrammatic sectional view of a known colour display tube of the "in-line" type. Three electron guns 5, 6 and 7 which generate three electron beams are provided on the neck 4 of a glass envelope 1 which is composed of a display window 2, a funnel-shaped part 3 and said neck. The axes of the electron guns are situated in one plane, namely the plane of the drawing. The axis of the central electron gun 6 coincides substantially with the tube axis 8. The three electron guns open into a sleeve 9 which is situated coaxially in the neck 4. The display window 2 comprises a plurality of triplets of phosphor lines on its inside. Each triplet comprises a line consisting of a green-luminescing phosphor, a line consisting of a blue-luminescing phosphor, and a line consisting of a red-luminescing phosphor. All triplets together constitute the display screen 10. The phosphor lines are perpendicular to the plan of the drawing. The shadow mask 11 in which a very large number of elongate apertures 12 have been provided through which the electron beams pass is provided in front of the display screen. The electron beams are deflected in the horizontal direction (in the plane of the drawing) and in the vertical direction (perpendicularly thereto) by the system of deflection coils 13. The three electron guns are assembled so that the axes enclose a small angle with each other. As a result of this the generated electron beams pass through the apertures 12 at the said angle, the so-called colour selection angle, and each impinge only on phosphor lines of one colour. A display tube has a good static convergence if the three electron beams, when not deflected, intersect each other substantially in the centre of the display screen. It has been found, however, that the static convergence often is not good, nor is the frame shape and the colour purity, which may be the result of an insufficiently accurate gun assembly and/or sealing of the electron guns in the neck of the tube.

By magnetizing a configuration of a magnetizable material, for example a ring, in such a manner that it causes a correction field, the defects in the convergence, the colour purity and the frame of the displayed picture can be eliminated for the greater part. This is described in greater detail in the above-mentioned U.S. Pat. No. 4,220,897 which may be considered to be incorporated herein by reference.

Figure 2:
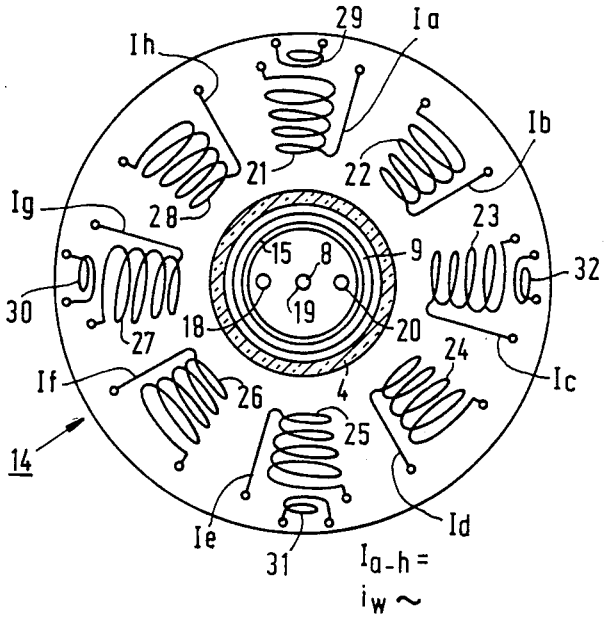
FIG. 2 is a sectional view of FIG. 1.

The magnetization device 14 comprises a multipole coil unit and alternating field coils as will be shown in FIG. 2. The device 14 is provided around a configuration of a magnetizable material, in this case a ring 15 of an alloy of Fe, Co, V and Cr (known by the trade name of Vicalloy) which is connected at the bottom of sleeve 9 around the electron beams. It will be obvious that the ring may alternatively be provided in other places around the guns or in or around the neck of the tube. Instead of a ring it is also possible to use a band or a configuration of rods or blocks of a magnetizable material. It is also possible to use more than one configuration or ring of a magnetizable material.

FIG. 2 is a sectional view of FIG. 1 taken on the line II—II. Present in the neck 4 is the sleeve 9 with the ring 15 placed at the bottom around the electron beams 18, 19 and 20. The magnetization unit 14 is provided around the tube neck 4. It comprises (regularly spaced) coils 21 to 28 to generating the desired multipole field. A multipole field is a combination of twopoles, quadrupoles, sixpoles and optionally multipoles. Dependent on the corrections to be carried out, various true twopoles, quadrupoles, sixpoles and optionally higher-order poles and combinations thereof can be generated by means of said multipole coil unit by causing suitable direct currents (represented by the symbol =) $I_a$ to $I_h$, respectively, to flow through the coils 21 to 28, respectively. The axes of the coils 21 to 28 extend radially from the tube axis 8. The magnetic fields generated by said coils in this case also are directed substantially radially. The magnetization unit furthermore comprises the (regularly spaced) alternating field coils 29, 30, 31 and 32 through which the decaying alternating current (represented by the symbol ~) $i_w$ flows with which the decaying magnetic alternating field is generated. The alternating current $i_w$ during the magnetization process must initially be so large that the material of the ring 15 on each side of the hysteresis curve is magnetized fully into saturation. When the alternating field has decayed, the ring 15 is magnetized as a multipole. The multipole in the ring generated by the multipole coil unit at the area of the ring (determined by the currents $I_2$ to $I_h$) is magnetized and the magnetization unit can be removed. It will be obvious that if the magnetization after one magnetization step is still not good, this may be repeated once or several times. As a result of the coice 50 Hz$<<F_{iw}<<$15625 Hz, wherein $F_{iw}$ is the frequency of the decaying alternating magnetic field ($<<$ means "much smaller") it is no longer necessary to switch off the current through the deflection coils during the magnetization. Nor is it necessary to switch off the voltages at the gun electrodes during the magnetization. The coils 29 to 32 may be omitted if the current $i_w$ is superimposed on the currents $I_a$ to $I_h$.

Figure 3:
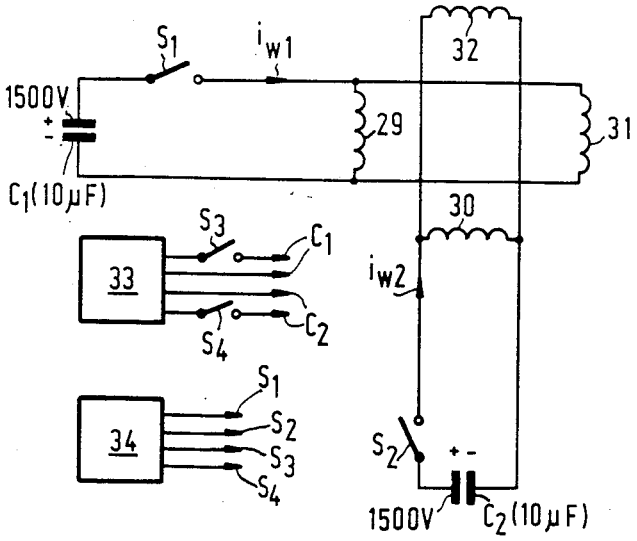
FIG. 3 shows the circuit of which the alternating field coils form part.

FIG. 3 shows diagrammatically the circuit of which the alternating field coils 29 to 32 form part. The coil pairs 29, 31 and 30, 32 the axes of which enclose an angle of 90° with each other (see FIG. 2) are energized with two alternating currents $i_{w1}$ and $i_{w2}$ which are shifted in phase 90° with respect to each other. The alternating current starts flowing after closing the switches $S_1$ and $S_2$. The simplest manner to make a high frequency alternating field which slowly decreases to zero is to connect the coil pairs to charged capacitors $C_1$ and $C_2$. The alternating current which then starts flowing decreases by an e-power according to $$i=\hat{i}_a e-(r/2L)\sin \omega t$$

Herein
$\omega=1/Lc$
$\hat{i}_a=150$ A
r=0.38 for the frequency used
t=the time in seconds
L=0.8 mH (for two cils in parallel)
c=10 μF.

The rate of decrease is determined by the r/2L ratio of the coil and may not be too high. In order to realize a rotating field in this manner, both coil pairs 29, 31 and 30, 32 must be connected each individually to capacitors $C_1$ and $C_2$, respectively. Because it is difficult to always maintain 90° phase difference between the currents $i_{w1}$ and $i_{w2}$, the switches are controlled. By always comparing the currents in the circuits, the phase error can be corrected per half cycle by means of the control unit 34 and the switches $S_1$ and $S_2$. This is reached by starting the switches $S_1$ and $S_2$ (thyristors which at current zero die out) each half cycle so that the faster circuit each time waits for the slower. As a result of this a rotating field is formed which each time stops a moment. Because this stopping of the rotating field occurs each half cycle, this is very little with small differences in the tuning frequency and there is no influence on the operating as long as the differences in the tuning frequency are small.

To generate the rotatingfield both capacitors $C_1$ and $C_2$ must be charged to 1500 volts. During the time that no rotating field is necessary, the capacitors $C_1$ and $C_2$ are charged from the supply unit 33, the control unit 34 closing the switches $S_3$ and $S_4$. As a result of the higher frequency of the decaying alternating magnetic field the voltage induced in the coils 21 to 28 increases. By means of the compensation coils 60 shown in FIG. 6 on the side of the coils 29, 30, 31 and 32 remote from the ring 15 and provided in series with the coils 21, 23, 25 and 27, large induced voltage can be compensated for. The direct current in these compensation coils does not contribute to the field in the ring 15.

It is also possible to rotate the coils 29 to 32 over 22.5° with respect to the coils 21 to 28 as a result of which the induced voltage in these latter coils decreases.

Figure 4:
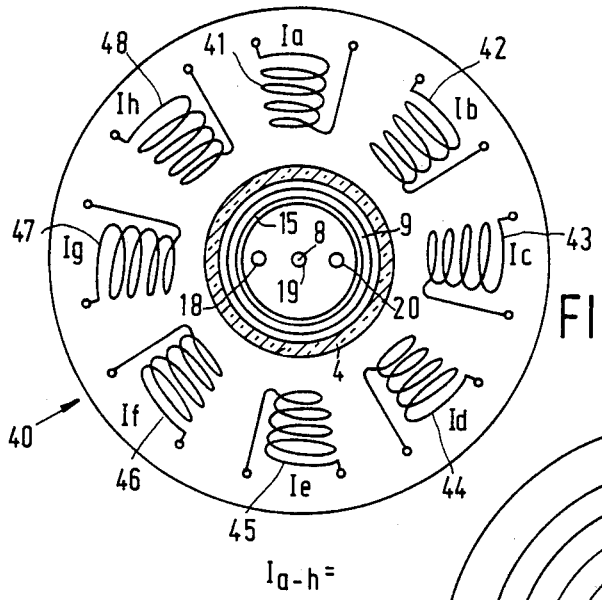
FIG. 4 is a first sectional view and FIG. 5 is a second sectional view of another magnetization device in accordance with the invention.
Figure 5:
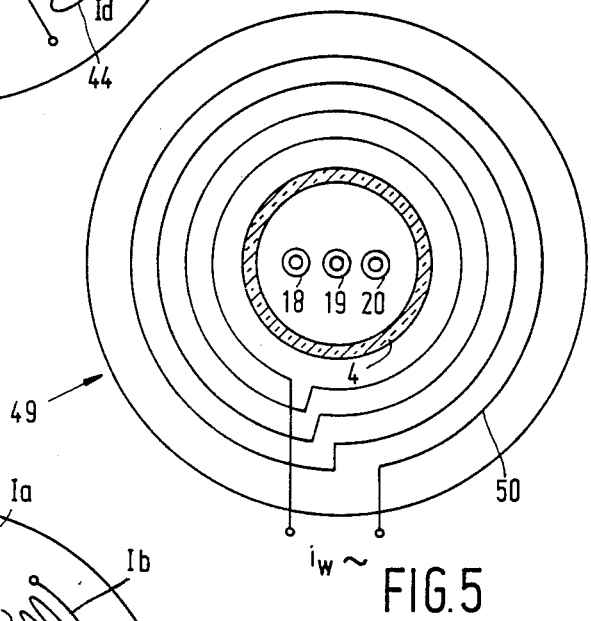

FIG. 4 is a first sectional view of a magnetization unit 40 which is analogous to the FIG. 2 unit and comprises eight (regularly-spaced) coils 41 to 48 for generating the desired multipole field. The coils for generating the alternating magnetic field are absent. An alternating field coil 49 shown in a second sectional view in FIG. 5 is placed against said coils. It comprises one coil 50 through which the decaying alternating current ($i_w$) flows with which the decaying alternating field is generated. This alternating magnetic field is axial and is directed substantially perpendicularly to the magnetic multipole field. As a result of this the crosstalk of the alternating field in the coils of the multipole coil unit (the coils 41 to 48) is minimum.

Figure 6:
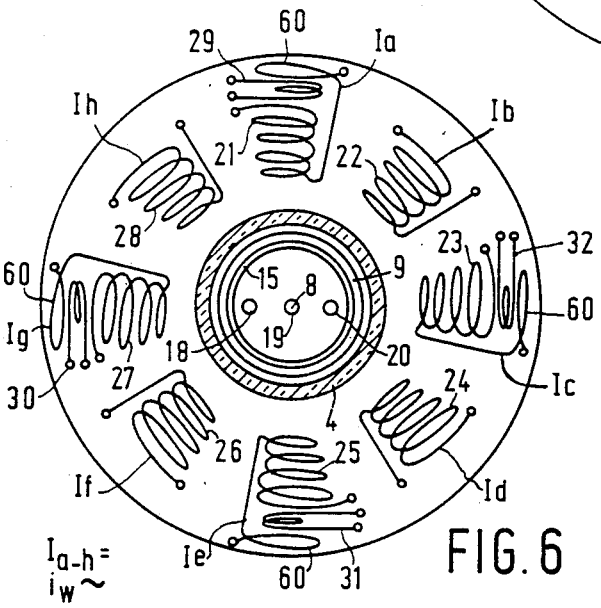
FIG. 6 shows a magnetization device according to FIG. 2 but with compensation coils.

FIG. 6 shows a magnetization device in which compensation coils 60 which are connected in series with the coils 21, 23, 25 and 27 of the multipole coil unit are provided around the axis of the alternating field coils 29, 30, 31 and 32 on the side remote from the tube axis. Voltage induced by the alternating field can be compensated for by means of said compensation coils. The current induced in the compensation coils should flow oppositely to the current induced in the coil of the multipole unit as a result of which the compensation occurs.

What is claimed is:

1. A method of manufacturing a color display tube in which magnetic poles are provided in or around the neck of the envelope and around the paths of the electron beams extending substantially parallel to the axis of the tube, said poles generating a permanent multipole magnetic field for the correction of the occurring convergence, color purity and frame defects of the color display tube, said magnetic poles being formed by the magnetization of a configuration of a magnetizable material which is provided around the paths of the electron beams, said configuration being magnetized by energizing a multipole coil unit by means of a combination of currents which generate a static multipole magnetic field and the magnetization is produced by means of a decaying alternating magnetic field which initially drives the magnetizable material on both sides of the hysteresis curve into saturation, characterized in that the magnetization takes place within one frame period and the decaying alternating magnetic field has a frequency between 400 Hz and 4000 Hz, the decrease of the amplitude of the alternating magnetic field being less than 10% per half a cycle.

2. A method as claimed in claim 1, characterized in that the decaying alternating magnetic field has a frequency between 1650 Hz and 1750 Hz, the decrease of the amplitude of the alternating magnetic field being less than 7% per half a cycle.

3. A method as claimed in claim 1 or 2, characterized in that the decaying alternating magnetic field is an axial magnetic field which is substantially parallel to the paths of the electron beams.

4. A device for carrying out the method as claimed in claim 1 or 2, characterized in that the said device comprises the following elements:

a. multipole coil unit comprising a number of magnetization coils which are positioned regularly around the tube axis and the axes of which extend substantially radially of the tube axis, b. four alternating field coils which are positioned regularly around the tube axis and the axes of which also extend substantially radially of the tube axis and each pair of diametrically oppositely located coils of which forms part of a current circuit which furthermore comprises a switching element and a capacitor, c. a supply unit for charging the capacitors, and d. a control for the switching elements.

5. A device as claimed in claim 4, characterized in that compensation coils which are connected in series with the coils of the multipole coil unit are provided around the axis of the alternating field coil on the side remote from the tube axis.

* * * * *